US005722922A

United States Patent [19]

Watterson et al.

[11] Patent Number: 5,722,922

[45] Date of Patent: Mar. 3, 1998

[54] AEROBIC AND ANAEROBIC EXERCISE MACHINE

[75] Inventors: Scott R. Watterson, River Heights; Curt G. Bingham; S. Ty Measom, both of Logan, all of Utah

[73] Assignee: ICON Health & Fitness, Inc., Logan, Utah

[21] Appl. No.: 412,096

[22] Filed: Mar. 28, 1995

Related U.S. Application Data

[63] Continuation of Ser. No. 57,452, May 4, 1993, abandoned, which is a continuation of Ser. No. 706,756, May 29, 1991, abandoned, which is a continuation-in-part of Ser. No. 647,554, Jan. 29, 1991, Pat. No. 5,135,216, which is a continuation-in-part of Ser. No. 644,456, Jan. 23, 1991, Pat. No. 5,062,627.

[51] Int. Cl.[6] ..... A63B 22/12; A63B 23/04

[52] U.S. Cl. ..... 482/136; 482/53

[58] Field of Search ..... 482/51, 52, 53, 482/136, 130

[56] References Cited

U.S. PATENT DOCUMENTS

| | | | |
|---|---|---|---|
| D. 284,597 | 7/1986 | Smith et al. . | |
| 3,647,209 | 3/1972 | La Lanne . | |
| 4,072,309 | 2/1978 | Wilson . | |
| 4,492,375 | 1/1985 | Connelly . | |
| 4,521,013 | 6/1985 | Dofel . | |
| 4,582,320 | 4/1986 | Shaw . | |
| 4,618,144 | 10/1986 | Gibson . | |
| 4,934,690 | 6/1990 | Bull | 482/53 |
| 5,062,627 | 11/1991 | Bingham | 482/53 |
| 5,135,216 | 8/1992 | Bingham et al. | 482/130 |
| 5,256,117 | 10/1993 | Potts | 482/52 |

OTHER PUBLICATIONS

Soloflex Owner's Manual from 1984.

Anonymous, "The Guided Muscle Program" for the Excel Space Gym, Cover Page and Two Unnumbered Pages, Believed to be Published in 1986 by Excel, The Exercise Company.

Anonymous Advertisement Brochure for the Excel Space Gym, Cover Page and pp. 14–15 Believed to be published in 1986 by or on Behalf of Excel, The Exercise Company.

Anonymous Sears Owner's Manual and Fitness Program for the Lifestyler 600, Multi–Function Climber, pp. 1–12, Copyright Date 1987, Believed to be published by Sears Roebuck and Company.

Anonymous Sunbanker Exer Owner's Manual and Fitness Program for the 50–Function Multi–Gym, Cover Sheets and pp. 1–36, Believed to be Published by or on Behalf of "Sunbanker".

Flex CTS–Weider Cross Training System, Owner's Manual, Model #870300, 11 pages; copy in 482/148 dated Mar. 1990.

*Primary Examiner*—Stephen R. Crow

*Attorney, Agent, or Firm*—Trask, Britt & Rossa

[57] ABSTRACT

An exercise machine has a base with an upright frame. A carriage is movable along the length of the frame and connectable thereto by a pin which registers with apertures formed in the frame. The pin is connected to a bridge with spans between cheek plates of the carriage. A lever structure and a butterfly exercise structure are pivotally secured to the carriage. Resistance modules are connectable to the carriage and the lever structure and the butterfly exercise structure to resist movement. A bench is provided for the user and is connected at one end to one frame. A stepper exercise assembly is also attached to the frame. A stepper has hydraulic resistance cylinders which include springs to urge the treadles in an upward direction.

23 Claims, 10 Drawing Sheets

AEROBIC AND ANAEROBIC EXERCISE MACHINE

This application is continuation of application Ser. No. 08/057,452, filed May 4, 1993, now abandoned, which is a continuation of application Ser. No. 07/706,756 filed May, 29, 1991 now abandoned which is a continuation-in-part, of application Ser. No. 07/647,554, filed Jan. 29, 1991, now U.S. Pat. No. 5,135,216, which was a continuation-in-part of application Ser. No. 07/644,456 filed on Jan. 23, 1991, now U.S. Pat. No. 5,062,627.

BACKGROUND

1. Field

This invention relates to exercise machines, and more particularly to machines for performing both aerobic and anaerobic exercises.

2. State of the Art

One goal of exercise is to enhance the strength and endurance of voluntary acting skeletal muscles. Another goal is to enhance the capacity and endurance of, for example, the heart and lungs.

Exercises are sometimes categorized according to their relative purpose or effectiveness in achieving a particular goal. For purposes of this application, those exercises most effective in strengthening voluntary acting skeletal muscles may be termed anaerobic or strength conditioning exercises. Strength conditioning exercises are also sometimes called weight-training exercises. Those which are most effective in enhancing cardiovascular performance or the condition of the heart and lungs may be termed aerobic exercises. It is usually desirable to include both aerobic and anaerobic exercises in an exercise program.

Aerobic exercises rely generally on rapid and extended repetitions of an exercise movement against low to moderate resistance. Running and jogging are examples of what are typically regarded as aerobic exercises. Treadmills and stepper-type machines are examples of machines for performing running, stepping or jogging-type exercises. U.S. Patents disclosing stepper-type exercise machines include U.S. Pat. Nos. 4,838,543 (Armstrong); U.S. Pat. No. 4,830,362 (Bull); U.S. Pat. No. 4,708,338 (Potts); and U.S. Pat. No. 4,909,504 (Yang).

Anaerobic exercises for muscle conditioning are usually performed by making a relatively few repetitive movements or repetitions (e.g.,10–30) against high resistance. Typically, anaerobic exercises involve a more static type of exercise in which the user pushes or pulls against a force which can be selected or adjusted consistent with the user's desires. For example, the exerciser may work against gravitational resistance by lifting free weights, or by lifting weights through an arrangement of pulleys, to develop increased strength. Weight machines are known which provide adjustable resistance for a selection of anaerobic exercises using different muscles and limbs. Such machines may include a bench portion so the user may recline to do, for example, press exercises, or sit to do, for example, leg lift exercises. Examples include the machines described in U.S. Pat. No. 4,809,972 (Rasmussen et al.); U.S. Pat. No. 4,898,381 (Gordon); U.S. Pat. No. 4,902,006 (Stallings); U.S. Pat. No. 4,861,025 (Rockwell); U.S. Pat. No. 4,799,671 (Hoggan et al.).; U.S. Pat. No. 4,930,768 (Lapcevic); U.S. Pat. No. 4,919,419 (Houston); U.S. Pat. No. 4,915,379 (Sapp); U.S. Pat. No. 4,900,018 (Ish et al.); and U.S. Pat. No. 4,915,377, U.S. Pat. No. 4,744,559 and U.S. Pat. No. 4,678,185 (Mahnke).

For many users, a home exercise apparatus greatly facilitates the regular performance of an exercise program. It is furthermore highly desirable to have a single machine useful for both anaerobic and aerobic conditioning. Only a few exercise machines combining both aerobic and anaerobic exercise functions are known. For example, U.S. Pat. No. 4,477,071 (Brown et al.) discloses a rowing machine (aerobic) which can be reconfigured and used for performing anaerobic exercises. U.S. Pat. Nos. 4,796,881 and 4,750,736 (Watterson) both disclose a rowing exerciser with a weight bench structure for anaerobic or strength exercises. U.S. Pat. No. 4,705,267 (Jackson) discloses a machine having a weight bench portion, a bicycle wind trainer and a rowing machine.

A wide variety of anaerobic machines have been devised. For example, U.S. Pat. No. 4,072,309 (Wilson) shows a machine which can be reconfigured to perform a number of different exercises. One form of this machine is available from SOLOFLEX of Hillsboro, Oreg. It has a grip or bar element adjustably mountable in height to a central post. The bar element is mountable to a fin which extends from the central post. The fin has adjustment holes for passage of a locking pin. The bar element must be repositioned or reconfigured to perform many of the different exercises. Further, the user's hair, clothing, or digits may become entangled in the operating structure of the SOLOFLEX device.

There appears to be a need for an apparatus having both aerobic and anaerobic structure, and particularly a stepping structure with weight-training structure which is operable in multiple configurations without repositioning the bar element.

SUMMARY OF THE INVENTION

An exercise apparatus combines a stepper means for aerobic conditioning with anaerobic exercise means for anaerobic conditioning. A frame member extends upwardly from a base means. The stepper means is attached to the frame member. The anaerobic exercise means is attached to the frame member, and is positioned away from the stepper means. The anaerobic exercise means is preferably weight-training means adapted to the frame member and positionable in a plurality of configurations for the performance of weight-training exercises. The weight-training means is preferably a lever pivotally adapted to said frame means with resistance means connected to said lever to resist movement thereof by the user.

The exercise apparatus of the instant invention preferably has a carriage means which is movably adapted to the frame member to move therealong. The weight training means, and more specifically the lever, is pivotally adapted to the carriage means so that repositioning of the carriage effectively reconfigures the machines to perform different exercises.

The apparatus may also include bench means for receiving a user thereon. The bench means has a first end removably attachable to the frame member and a second end with support members adapted to support the second end above the base support means.

In a preferred arrangement, the carriage means is formed to have a channel sized to slidably receive the frame member therethrough. The frame member has a length and the carriage means is movable along the length thereof. Connecting means is desirably provided to connect the carriage means to the frame member in selected positions along the length of the frame member.

Preferably, the channel of the carriage means is defined by opposite cheek members or plates extending along the frame member and away therefrom.

In an alternate arrangement, the resistance means has a first end removably secured to the carriage means and a second end removably secured to the lever means. The carriage means desirably has a first securing means positioned relative to the lever means for securing the resistance means, and more particularly the first end of the resistance means, to the carriage means in a first configuration. A second securing means is also positioned on the carriage means relative to the lever means and spaced from the first securing means, also for securing the first end of the resistance means to the carriage means, but in a second configuration.

Desirably, the lever means has a pair of spaced-apart arms sized to snugly and slidably receive the carriage means therebetween. The cheek plates have an aperture formed therein which apertures are in substantial alignment. The arms have apertures formed therein. The lever means is therefore pivotally secured to the carriage means by a pin positioned to extend through the apertures in the cheek plates and the apertures formed in the arms.

The arms extend between the first securing means and the second securing means which both extend outwardly from the carriage means. Desirably, the first securing means and the second securing means are each first and second pins, respectively, which extend outwardly from each of the cheek plates. The arms each have a finger extending outwardly therefrom. The resistance means includes at least one resistance module connected between a finger and a first or second pin selected by the user.

The resistance module preferably includes an elastic formed in an unending loop which is trainable about a finger and a first pin or a second pin as selected by the user. Preferably, the resistance module includes a pair of spool-shaped ends each including a cylinder with two ends, with an aperture formed through the cylinder sized to snugly and slidably receive the finger and the first and second pins therethrough. The elastic is trained around a portion of the cylinder of each of the spool-shaped ends. A loop shield means is attached to each of the spool-shaped ends to shield the user from the resilient loop.

In yet another configuration, the bench means includes attaching means for attaching the bench at its first end to the frame member in a plurality of positions along the length of the frame member. In yet another embodiment, the apparatus may include a left arm and a right arm each pivotally attached to the carriage means for rotation toward each other to perform "butterfly"-type exercises. The carriage means may include a transverse plate with apertures formed to receive a left pivot pin and a right pivot pin spaced from the left pivot pin. The left and right arms have apertures formed to receive left and right pivot pins for pivoting movement thereabout. The left arm has a first upstanding finger and the transverse plate has a second upstanding finger wherein butterfly resistance means is interconnected between the first finger and the second finger. Butterfly resistance means may include an elastic trained around a pair of cylindrical spools to receive the elastic thereabout. A resistance module may be used as the butterfly resistance means.

In yet a further embodiment, the stepper exercise means includes a first treadle spaced from a second treadle, both being pivotally mounted to the frame member. Resistance means is interconnected between the frame member and the first treadle and the second treadle to resist movement of the treadles. A reciprocator means is interconnected between the first treadle and the second treadle to cause reciprocation thereof with respect to each other.

Reciprocator means preferably includes rocker means attached to the frame member to contact both the first treadle and the second treadle. The rocker means has a midpoint about which its opposite end rotates. One opposite end is positioned under one treadle and the other opposite end is positioned under the other treadle. The opposite ends include rollers which have engaging means to interconnect to the first treadle and the second treadle, respectively.

In a highly preferred arrangement, the frame member is rectilinear in cross-section.

In another arrangement, the exercise apparatus may also have a frame which has a base for positioning on a surface under upright member connected to said base. Treadles are mounted to the frame for operation by the feet of a user. Resistance means are interconnected between the frame and the treadles to resist downward movement. Return means are mechanically associated with the resistance means to urge upward movement of the treadles. Preferably the resistance means has a piston disposed with a chamber filled with hydraulic fluid. The return means may be a spring positioned between the piston and the wall of the chamber.

BRIEF DESCRIPTION OF THE DRAWINGS

In the drawings, which illustrate what is presently regarded as the preferred embodiment.

DETAILED DESCRIPTION OF THE INVENTION

Figure 1:
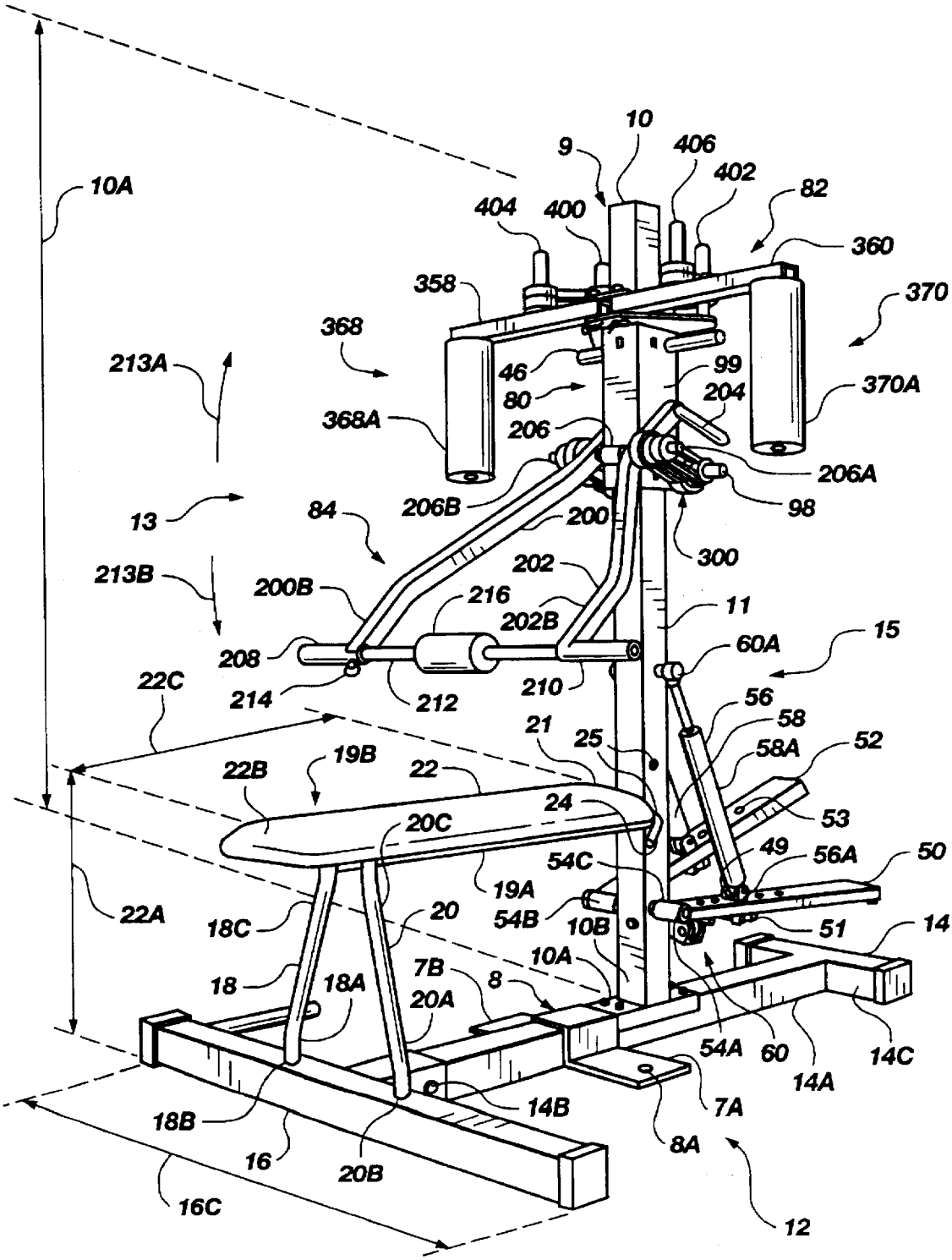
FIG. 1 is a perspective view of the apparatus of the invention.

FIG. 1 illustrates a multipurpose exercise device which has a weight bench portion 13 and a stepper portion 15 disposed away from each other and, as here shown, on opposite sides of an upright frame member 10. The frame member 10 has sides 9 and 11, and is here shown as a hollow tube member welded to a flanged base 10A at its lower end 10B. The flanged base 10A in turn is bolted to the T base portion 14 as shown.

The frame 10 as shown is square in cross-section. However, the cross-section may be rectilinear, round, oval, or any other desired shape in which the frame member 10 is sufficiently rigid to not deform in use.

The frame member 10 is removably mounted to a base support 12 which has a T base portion 14 and a base end portion 16. The T base portion 14 is removably connected to the base end portion 16 by bolts 14B to permit disassembly and reassembly for storage and shipping. The base support 12 is sized to support the apparatus on a support surface. That is, the base end portion 16 and the cross-member 14C are sized in length 16C to provide the apparatus with stability so that it cannot be easily or accidentally tipped over. For example, the base end portion 16 may be sized to be about 3 feet in length 16C.

A stabilizing plate 8 is optionally positionable over the long portion 14A of the T base 14 with plate portions 7A and 7B resting on the support surface on opposite sides of the long portion 14A. The plate 8 has apertures such as hole 8A formed therein to permit a user to secure the apparatus to a support surface with screws, nails or the like. The base support 12 is here assembled to result in an "T"-shaped structure. Other arrangements or configurations such as "X"- or "H"-shaped structure may be used if desired.

As shown in FIG. 1, a bench 22 is provided to support a user thereon during the performance of selected exercises. The bench 22 is elevated from the support surface a distance 22A preselected so adult users may recline thereon with their legs bent at the knees and their feet on the floor (see FIG. 9). The bench 22 is supported at its outward end 22B by bench legs 18 and 20.

The lower ends 18A and 20A of bench legs 18, 20 can be inserted removably into holes 18B and 20B formed in the end portion 16 to stably secure the bench 22. The bench 22 has a pair of spaced-apart bench supports 19A and 19B (see FIG. 9) to provide structural strength to bench 22. The supports 19A and 19B in this embodiment are formed of angle bar (i.e., two metal strips joined and substantially normal to each other) and extend along the length 22C of the bench 22. The supports 19A and 19B are secured to the bench by screws 19C or other acceptable fasteners. Legs 18 and 20 (FIG. 2A) are connected to each other at their upper ends 18C and 20C by a cross-member 20D. The cross-member 20D fits removably into grooves 19D and 19E in the bench supports 19.

As stated, the bench supports 19A and 19B are preferably formed of angle bar metal with one element or side arranged perpendicular to the other. At the inward end 21 of the bench 22, the supports 19 are configured into means for removably connecting the bench 22 to the frame member 10. The bench supports 19A and 19B have one side 19F and gb of the angle bar secured by screws 19C or the like to the underside of the bench 22. At the distal end a and gm, the downwardly extending side 19K and 19L of the bench supports 19A and 19B extends beyond the inward end 21 (FIG. 1) of the bench 22.

The connecting means which removably mounts the bench 22 to the frame member 10 is here shown as a mount bar 24 which can slide through any of a plurality of holes 25 formed through and along the length 10A of the frame member 10 and apertures 19M and 19N formed through the extended portions 19H and 19J of the bench supports 19A and 19B. However, any other detachable mounting means may be used to mount the inward end 21 to the frame member 10. Using the plurality of holes 25, the user may then position the inward end 21 of the bench 22 along the length 10A of the frame member 10 to place the bench 22 in different configurations, including slanting configurations, to perform exercises in different orientations.

The stepper portion 15 of the apparatus includes a pair of treadles or pedals 50 and 52 which are pivotally mounted by pedal mounting means to the frame member 10. A reciprocator assembly 60 is mounted to the frame member 10 below the pedal mounting means. Hydraulic cylinders 56, 58 constituting pedal resistance means are operably connected at their lower ends to the pedals 50 and 52 and at their upper ends to the frame member 10 by connection means which is here shown as a bolt 60A fixed to the upper ends of both cylinders 56 and 58 and passing through holes formed in the frame member 10.

Figure 13:
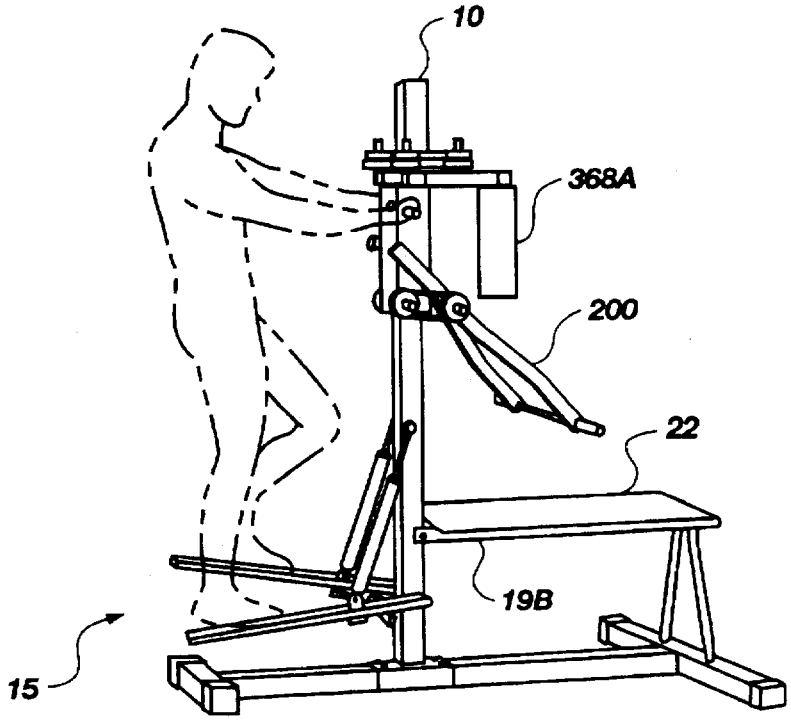
FIG. 13 illustrates a user performing an aerobic conditioning exercise on the apparatus of the invention.

As can be seen, the hydraulic cylinders 56 and 58 are detachably connected to the pedals 50 and 52. As shown, each cylinder 56 and 58 has a bracket 56A and 58A rotatably attached to the lower end thereof. A bolt 49 passes through the brackets 56A and 58A and one of the holes 53 in the pedals 50 and 52 and is fixed in place by a wing nut 51 positioned over the portion of the bolt 49 extending below its respective pedal 50 and 52. The effective resistance to a user performing a stepping exercise may therefore be varied by the user by selecting a desired hole 53 in the pedals 50 and 52 and connecting the lower ends of the cylinders 56 and 58 thereto. FIG. 13 shows a user performing an aerobic conditioning exercise on the stepper portion 15 of the apparatus of the invention.

Figure 4:
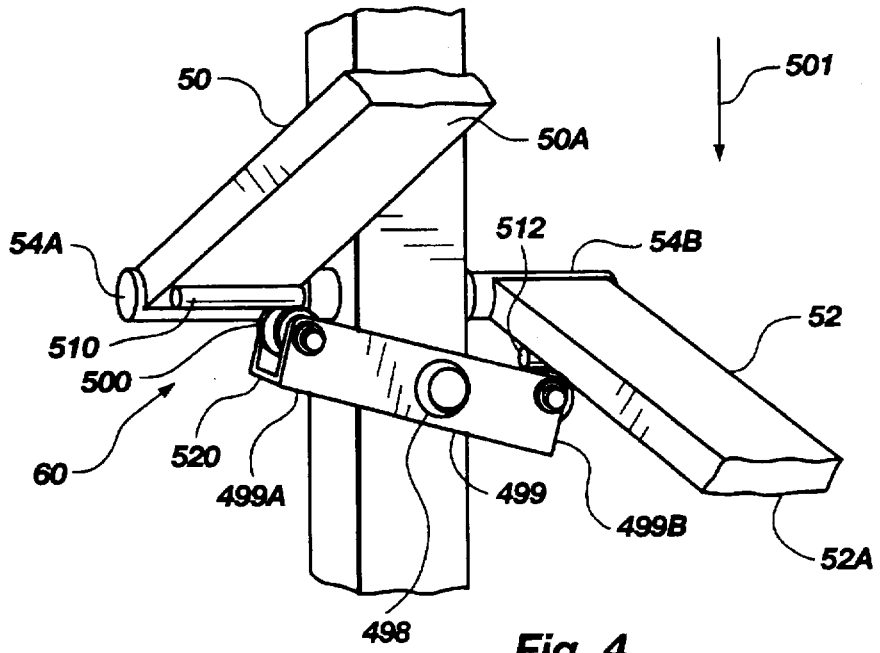
FIG. 4 is a partial perspective view of the reciprocator means of the apparatus of the invention.
Figure 5:
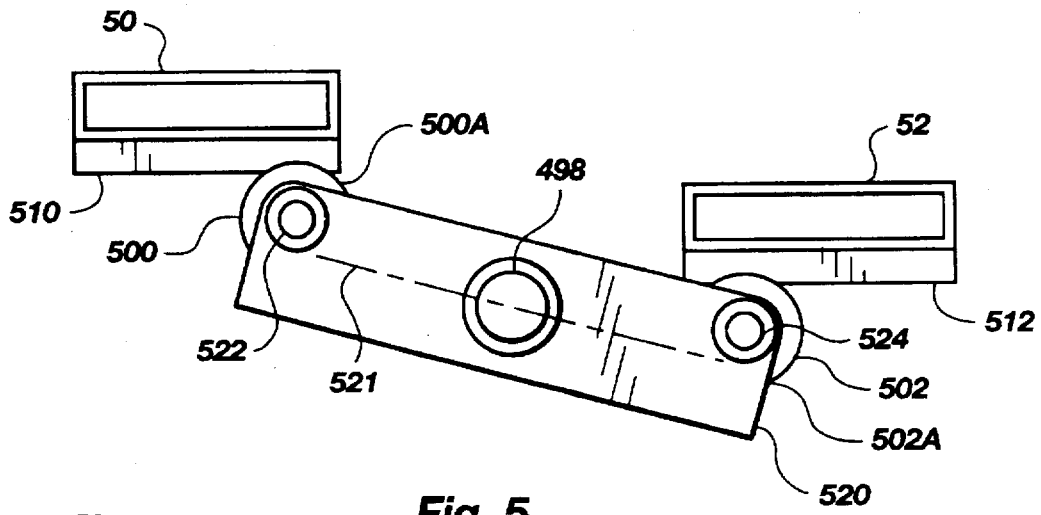
FIG. 5 is a partial end view of the reciprocator means of FIG. 4.
Figure 6:
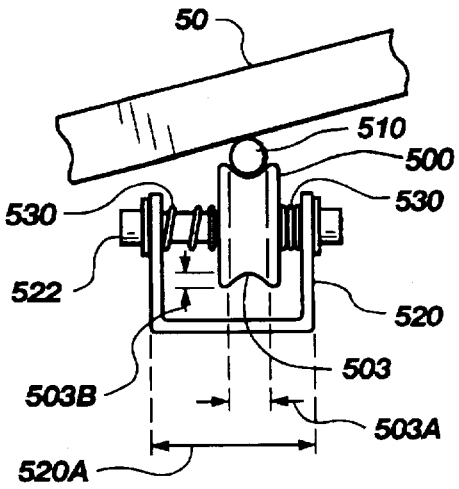
FIG. 6 is a partial side view of the reciprocator means of FIG. 4.

As stated, the stepper portion 15 of the apparatus includes reciprocator means 60 mounted to the frame member 10 beneath the pedals 50 and 52. The reciprocator means is best seen in FIGS. 4–6. It includes rocker means, which is here shown as a member 499, pivotingly mounted at a center pivot point 498 to the frame member 10. The opposing ends 499A and 499B of the member 499 are adapted to engage with structure secured to the undersides 50A and 52A of the pedals 50 and 52, respectively. A pair of rollers 500, 502 are mounted to member 499 at the ends 499A and 499B. Each roller 500 and 502 has an outside surface 500A and 502A oriented to contact the underside 50A and 52A of the pedals 50 and 52.

As shown in FIG. 4 and FIG. 6, each roller 500 and 502 has a circumferential groove such as groove 503 (FIG. 6) shaped to receive one of the structure secured to the undersides 50A and 52A which in this arrangement are the roller bars 510 and 512. As pedals 50 and 52 move downwardly 501, its respective roller bar 510 and 512 contacts its respective roller 500 and 502. Its respective end 499A and 499B is thereby forced downward, causing channel member 499 to pivot about the pivot point 498,thereby forcing the opposing end of the rocker means upward and raising the opposite pedal (FIGS. 4 and 5). The reciprocator 60 thus ensures a reciprocating action of the pedals 50 and 52.

Member 499 as illustrated in FIGS. 4–6 is an upward-facing open channel 520; and the rollers 510, 512 are slidably mounted on channel bars 522, 524 extending between opposing sides of the channel 520 and essentially perpendicular to its longitudinal axis 521. The pedal roller bar 510, 512 engages the groove 503 of its respective roller 500 and 502 through the longitudinal opening of the channel. Each groove 503 is formed to have a width 503A and a depth 503B to receive its respective roller bar 510, 512 so that the roller bar 510, 512 may exert an axial or transverse force to urge its respective roller 500 and 502 along its respective channel bar 522 and 524. That is, the roller bars 510 and 512 move toward and away from the frame member 10 as the pedals 50 and 52 are rotated upwardly and downwardly through an arc in the performance of exercises. The movement of the roller bars 510 and 512 is translated to the rollers 500 and 502, respectively, which move on the channel bars 522 and 524. The channel 520 is sized in width 520A so that the rollers 500 and 502 may move along the channel bars 522 and 524 therewithin through movement of the pedals 50 and 52 through their normal arc in the performance of exercises.

Springs 530 are positioned on the channel bars 522 and 524 on opposite sides of each roller 500 and 502 (FIG. 6) to urge it toward the middle of its respective channel bar 522 and 524. Thus the rollers 500 and 502 always have a force being exerted so they do not become locked in a position at either end of their travel on the channel bars 522 and 524.

The reciprocator means 60 illustrated is simple, durable, and offers great ease of assembly. When associated with a stepper exercise machine, the machine and the reciprocator can be substantially disassembled to a very compact state for shipping, and re-assembled to an operational state without difficulty. Also, the manufacturing tolerances within which smooth and reliable reciprocating action is achieved are relatively broad, making for inexpensive and reliable manufacture.

Referring back to FIGS. 1, 2 and 3, a carriage assembly 80 is adjustably associated with the frame member 10 to move along the length 10A thereof. The carriage assembly 80 supports a butterfly bar assembly 82 and a lateral bar assembly 84. As noted earlier, the frame member 10 may have any desired cross-sectional configuration. The carriage assembly 80 is shaped to snugly and slidably conform thereto. That is, it is formed to have a channel 80A within which the frame member 10 is slidably and snugly received. In the illustrated arrangement, the frame member 10 is square in cross-section and is a hollow square metal tube sized in height or length 10A so that the carriage assembly 80 can be moved to different heights to accommodate users of different size and to provide for reconfiguration for the performance of different exercises including those illustrated in FIGS. 9–12.

The carriage assembly 80 is a rectangular sleeve having one substantially open, longitudinal side which faces the stepper portion 15 of the apparatus. The sides 99 and 101 of the carriage assembly 80 are cheek plates which have a width 106 significantly greater than that of the corresponding exterior dimension 102 of the frame member 10. The width 106 is selected to provide sufficient structure to form the apertures and to provide the necessary structural rigidity for the exercises to be performed. The distance 105 between the sides 99 and 101 is slightly greater than the corresponding dimensions 103 of the frame member 10 to allow the carriage assembly to slide over the frame member 10.

Figure 3:
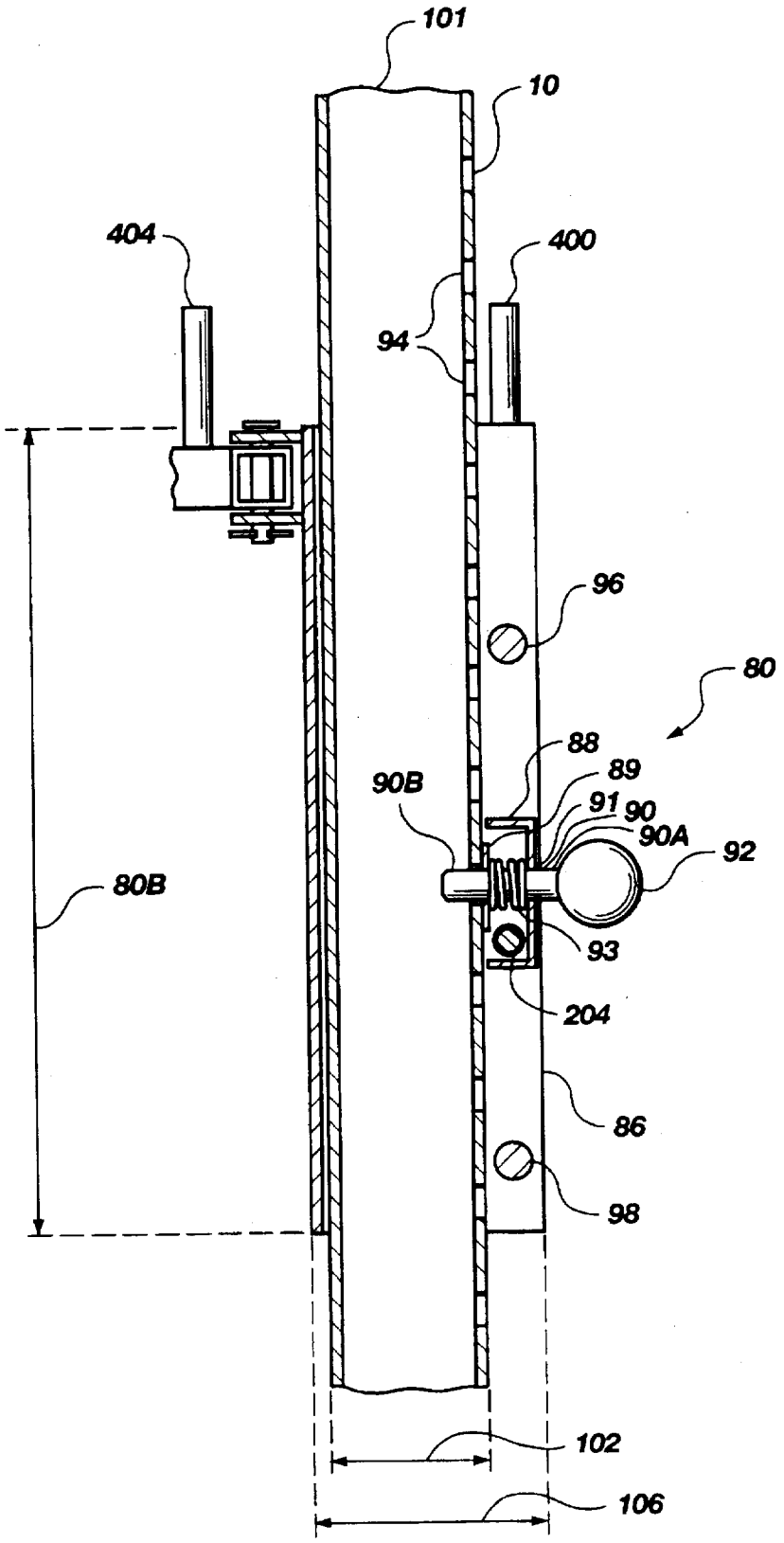
FIG. 3 is a cross-sectional view taken along line 3—3 of FIG. 2.

A bridge 88 connects sides 99 and 101. Adjustment means are connected thereto so the carriage assembly 80 may be adjustably positioned along the length 10A of the frame member 10. The adjustment means here includes a pin 90 having a knob 92 at its proximal end 90A for operation by the user. The pin 90 is secured in an aperture 91 in the bridge 88. Preferably, pin 90 has a collar 89 rigidly attached around it and positioned towards the distal end 90B of pin 90 (FIG. 3). A spring 93 is positioned between the bridge 88 and the collar 89. In the default position, the spring 93 urges the distal end 90B of pin 90 toward the frame member 10, and, when the carriage assembly 80 is appropriately aligned, into one of a plurality of apertures 94 formed in the frame member 10 along its length 10A. The knob 92 may be pulled outward against the spring force exerted by spring 93 to remove the pin 90 from the selected aperture in which it is seated, so the carriage may be moved up or down along frame member 10. The carriage 80 can then be fixed in a new position by aligning the pin 90 with any one of the holes 94 on the frame member 10, and releasing the knob 92 so that the spring urges pin 90 into the selected hole.

Figure 2:
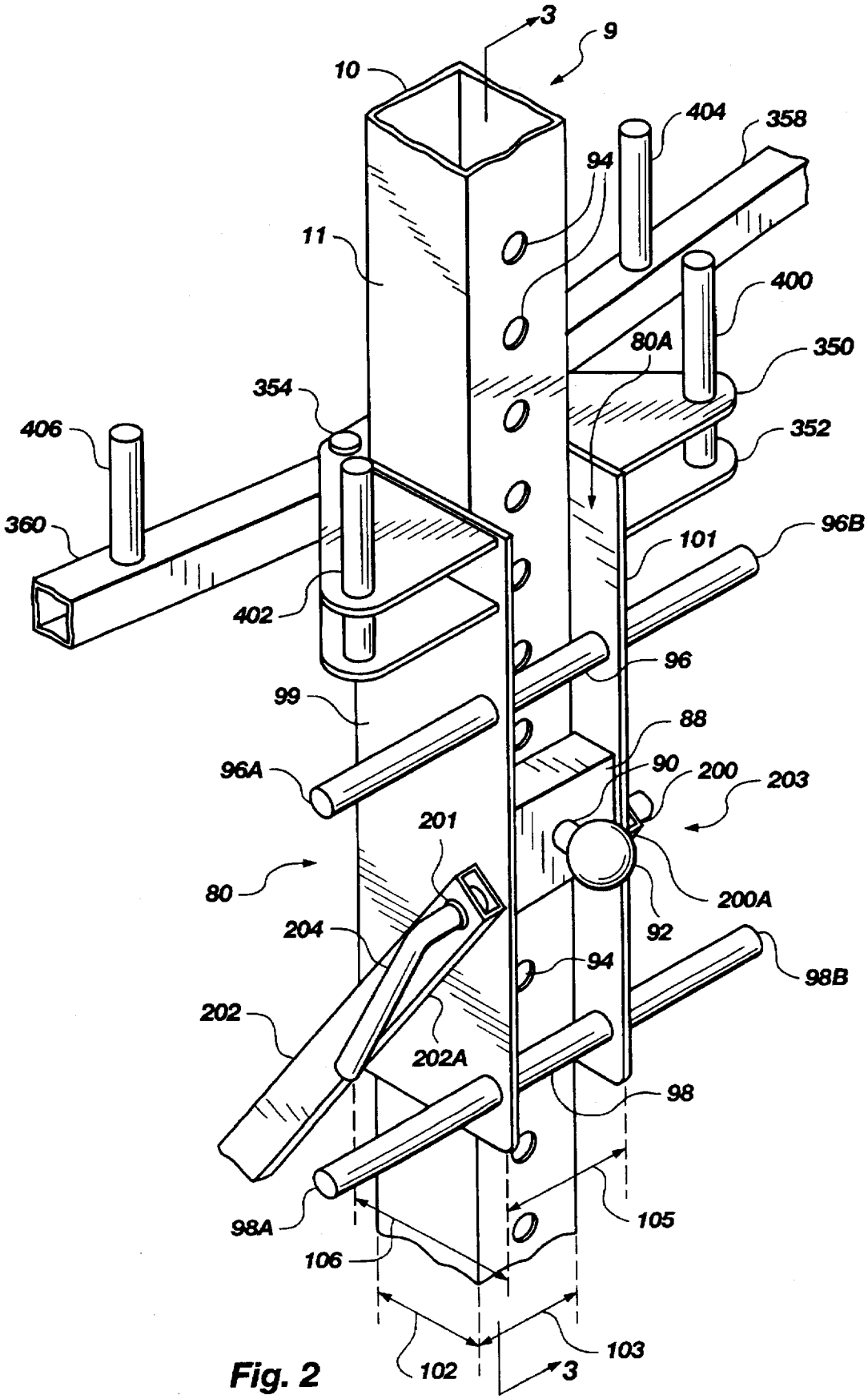
FIG. 2 is a perspective view of a portion of the apparatus of the invention including a carriage assembly thereof.
Figure 2A:
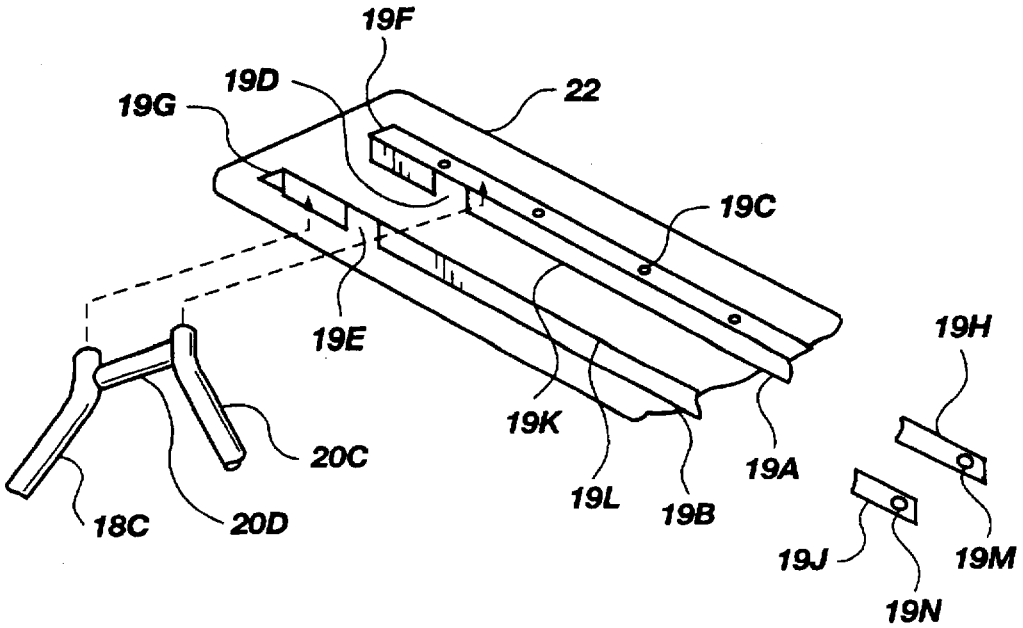
FIG. 2A is a partial perspective view of the under- side of a bench for use with the invention.

Referring to FIGS. 1 and 2, it is seen that the lateral bar assembly 84 is a lever formed of two spaced-apart arms 200 and 202 which are attached to the carriage 80 at the sides 99 and 101 by attachment means. As here shown, the attachment means is an angled pin 204 which slides through holes 201 and 203 in the proximal ends 200A and 202A of the arms 200 and 202 via corresponding holes in the sides 99 and 101 of the carriage 80. It may be appreciated that the holes in the sides 99 and 101 may be in another location and also that a plurality of holes may be formed so the arms 200 and 202 may be positioned along the length 280B of the carriage assembly 80 and thus be operated in different configurations.

Each of the arms 200, 202 is shaped approximately as one-half of a bisected "Y". A connector bar 206 extends between and is rigidly fixed to both of the arms 200 and 202. The connector bar 206 thus holds the arms 200, 202 in fixed relation to each other at the inward ends thereof. Grip portions 208 and 210 extend from the outward ends 200B and 202B of the arms 200, 202. The grip portions 208 and 210 are formed as hollow tubes extending substantially parallel to the connector bar 206. A lateral bar 212 is configured to extend between the lateral grip portions with its ends slidably positioned within the hollow tubes. The lateral bar 212 is removably fixed in such position by a cotter pin 214 passing through complementary holes in the lateral bar and in one of the grip portions. An optional pad 216 made of foam or any other desired cushion material fits over a portion of the lateral bar 212.

The arms 200 and 202 function as a lever for operation by the user. Resistance means is connected to the lever to resist movement of the lever by the user in the performance of exercises. Various resistance means may be used. However, the illustrated resistance means is interconnected between the lever or arms 200 and 202 and the carriage assembly 80 to resist movement upwardly 213A and downwardly 213B.

As illustrated, the resistance means includes elastic members which are removably connected to the arms 200 and 202 and to the carriage assembly 80 by connection means which includes a first carriage bar 96 positioned above the bridge 88. The first carriage bar 96 extends through and is rigidly fixed in a pair of holes in sides 99 and 101. A second carriage bar 98 is similarly attached to the carriage assembly 80, spaced from and below the first carriage bar 96 and also the bridge 88. Carriage bars 96 and 98 have side extensions 96A, 96B and 98A, 98B, respectively, which support a portion of the resistance means as selected by the user described hereinafter. The carriage bars 96 and 98 may also serve as handgrips for a user performing an exercise on the stepping portion 15 of the apparatus, as seen in FIG. 13.

The connection means also includes pins or fingers 206A and 206B connected to the arms 200 and 202. In this arrangement, the pins or fingers 206A and 206B are extensions of connector bar 206. Alternately, separate fingers may be secured to the arms 200 and 202.

The apparatus includes resistance means to resist movement of the arms 200 and 202. The resistance means may be any elastic or deformable device to resist movement in the performance of anaerobic or weight-training exercises.

Preferably, the resistance means is detachable to permit transfer for use in a plurality of resistance configurations suitable for different weight exercises.

Figure 7:
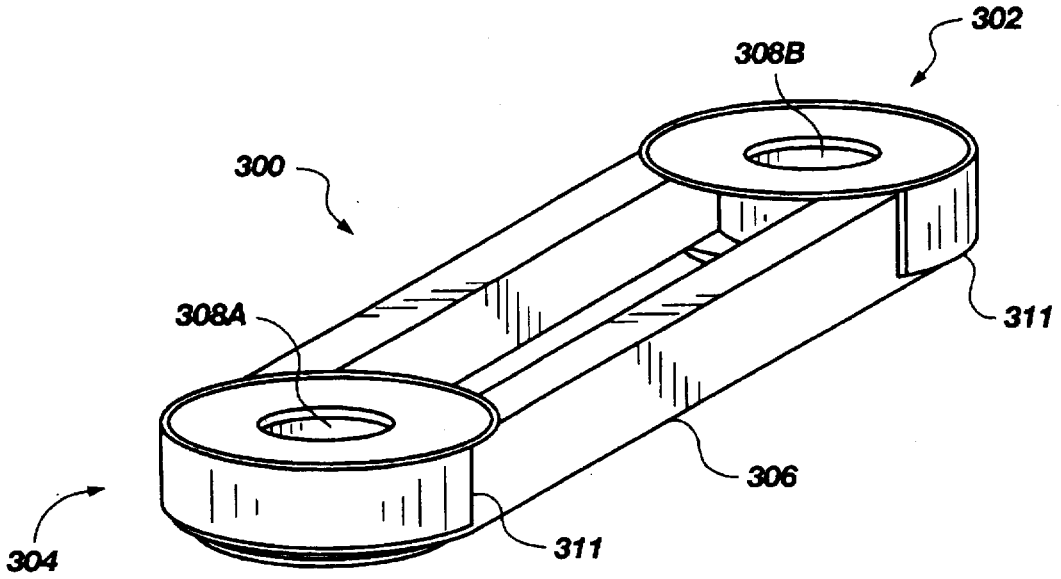
FIG. 7 is a perspective view of resistance means of the apparatus of the invention.

The desired resistance means includes a number of resistance elements 300 shown in FIG. 7 to have a pair of pulley ends 302 and 304 connected by an elastic or resilient pulley loop 306. The pulley ends 302 and 304 are configured approximately as spools having circular, central axial openings 308A and 308B. Openings 308A and 308B are configured to slidably and snugly fit over or on bars 96 and 98, fingers 206A and 206B, and pins 400, 402, 404, and 406. The bars 96 and 98, fingers 206A an 206B, and pins 400, 402, 404,and 406 all have the same exterior cross-section (although their respective lengths may vary), so that the openings 308A and 308B may be sized and shaped to be the same in cross-section. Thus, a resistance element 300 may be used in multiple configurations.

Figure 8:
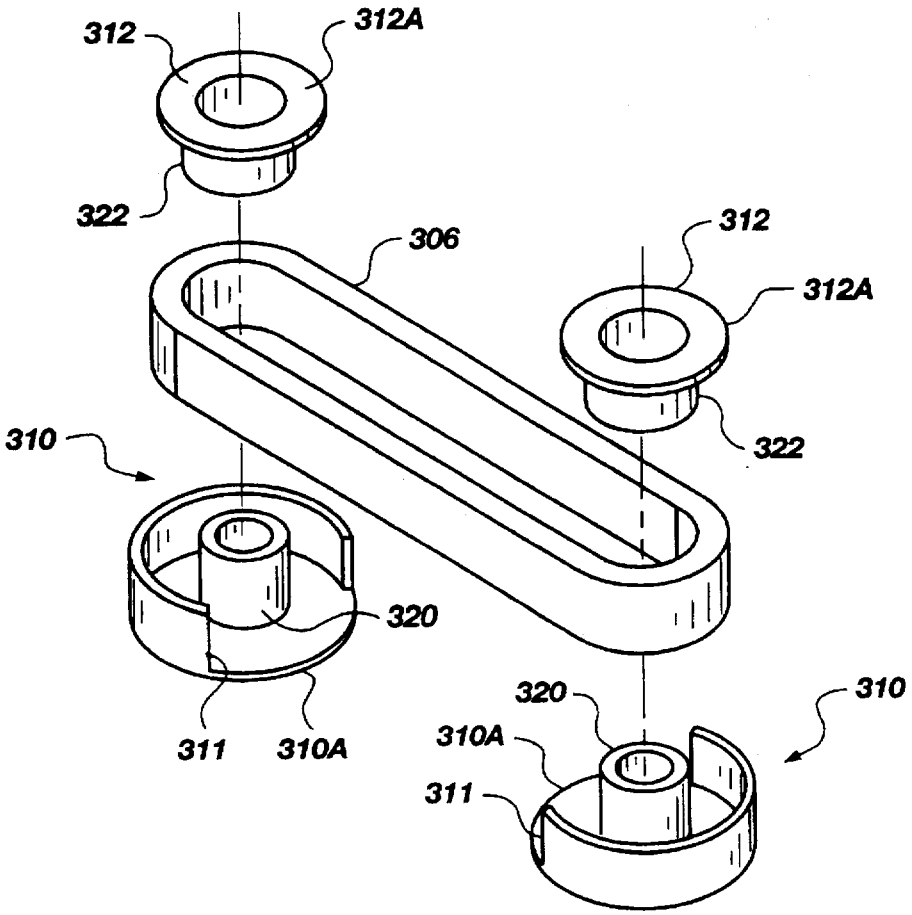
FIG. 8 is an exploded perspective view of the resistance means of FIG. 7.

As shown in FIGS. 7 and 8, the pulley ends 302 and 304 each have a shield portion 311 extending to enclose the resilient loop 306 along or about the perimeter formed by positioning the loop 306 about the pulley ends 302 and 304. The shield 311 is positioned to inhibit movement of a broken pulley loop 306. That is, a pulley loop 306 may break under tension and thereby be propelled toward persons or objects nearby. The shield 311 acts to inhibit such movement. The shield portion also helps prevent a user's hair, clothing, and digits from becoming entangled with the pulley loop 306.

As shown in FIG. 8, each pulley end 302 and 304 may be formed to have two annular segments 310, 312 mutually configured to snap together or apart. In FIG. 8, it is seen that the spool portions 320, 322 of annular segments 310 and 312, respectively, have diameters such that the spool portion 320 of annular segment 310 can fit slidably but snugly within the central opening of spool portion 322 of annular segment 312. Annular segments 310 and 312 can thus be easily pulled apart and snapped together for replacement of the resilient pulley loop 306. Moreover, the annular segments 310 and 312 can be easily manufactured by molding processes. In FIG. 8, segment 310 is shown to be the one having the shield 311, but the shield could also be located on segment 312. Also, annular segments 310 and 312 each have an outer cover or flange 310A and 312A. The flanges 310A and 312A keep the pulley loop 306 in alignment on the spool 320 and also act to inhibit movement of the pulley loop 306 in the event it breaks under tension. Notably, the pulley loop 306 acts to hold segments 310 and 312 together when under tension.

The pulley ends 302 and 304 may be made of any suitable rigid material, but are preferably made of plastic which is easy to manufacture and very lightweight. The resilient pulley loop 306 may be made of any resilient material which can be elastically deformed, which in the preferred embodiment is a laminated rubber.

Figure 14:
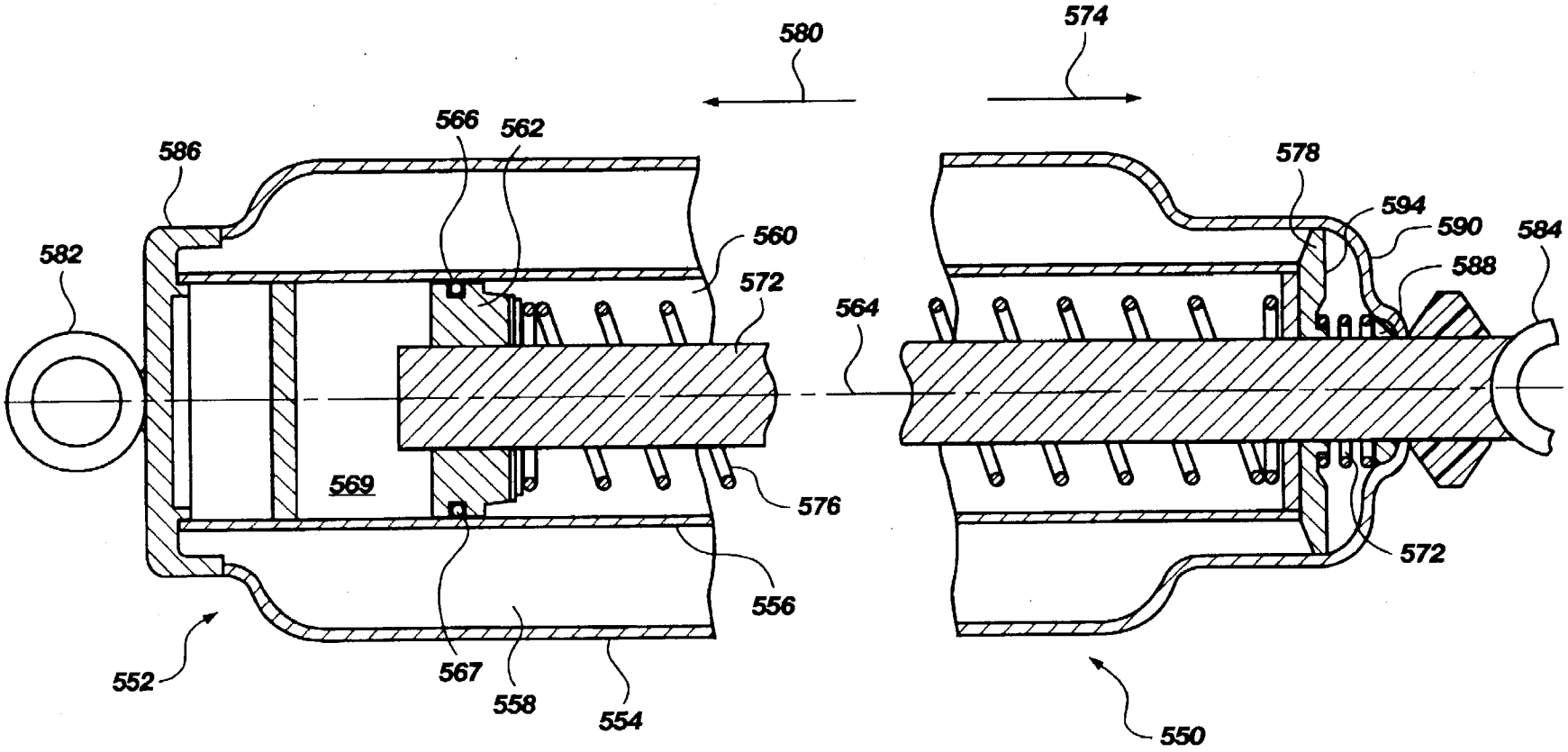
FIG. 14 is a partial cross-section of cylinders for use with the invention.

Referring to FIG. 14, an alternate cylinder 550 is depicted for use with the stepper portion 15 as shown in FIG. 1. The cylinder 550 of FIG. 14 has a housing 552 with an external wall 554 and an interior wall 556 with a chamber 558 thereinbetween. The interior wall 556 is formed into a cylinder and in turn defines thereinbetween a second chamber 560. A piston 562 is positioned within the chamber 560 to slide therein along the axis 564. The piston 562 is cylindrically shaped and sized to snugly and slidably fit within the interior wall 556. An "0"-ring 566 is positioned in an appropriate groove 567 to provide a seal.

Figure 15:
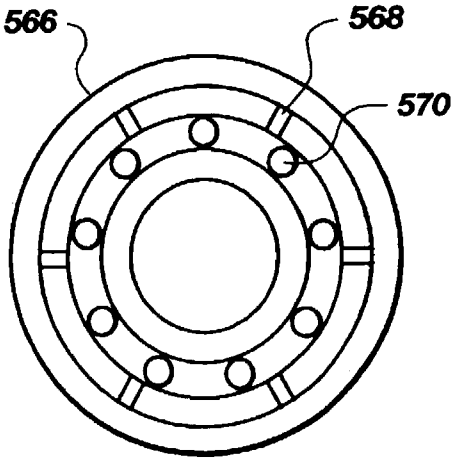
FIG. 15 is an end view of a piston for use in the cylinder of FIG. 14.

Upon movement of the piston 562 in an axial direction, hydraulic fluid 569 from either side is forced to flow through appropriately sized apertures 568 and 570 formed in the piston 566. The piston 562 is connected to a shaft 572 which extends exterior the housing 552. Upon movement of the shaft 572 along the axis 564 in an outward direction 574, hydraulic fluid is ported through apertures 568 (FIG. 15) which are sized to provide appropriate resistance to movement of treadles such as such as treadles 50 and 52 illustrated in FIG. 1.

As can be seen, the hydraulic cylinder 550 also contains a spring 576 positioned within the chamber 560 to extend between the piston 562 and an interior end piece 578. Upon movement of the piston 562 and the shaft 576 in an outward direction 574,the spring 576 is compressed. That is, the user urges a treadle such as treadle 50 in a downward direction, thereby causing the shaft 572 to extend outwardly from the housing 532. In turn, spring 576 is compressed by the piston 562. Upon removal of the user's foot or lessening of the downward force, the spring 576 urges the piston 562 and the shaft 572 in an inward direction 580. Hydraulic fluid is ported through the other apertures 570 shown in FIG. 15. Notably, the cross-sectional area available for fluid flow for the apertures 570 is larger than the aperture cross-section of the apertures 568 to facilitate return movement of the treadle 50 to its upward or ready position.

As illustrated in FIG. 14, the cylinder 550 has an end ring 582 to facilitate attachment to the treadle 50 or to the upright member 11 as desired. A similar ring shown in partial cutaway 584 is affixed to the shaft 572 also to facilitate attachment to the frame or treadle.

The housing 552 has a bottom structure end cap 586 which is sealingly positioned to permit hydraulic fluid to flow between the chamber 558 and the inner chamber 560.

The housing 552 also has a seal 588 which is positioned in a top end cap 590 and held sealingly in place by a spring 592 which is registered in a spring retainer 594.

Use of a cylinder 550 of the type illustrated in FIG. 14 with a stepper structure 15 shown in FIG. 1 eliminates the need for reciprocator means 60 mounted to the frame 10 as illustrated in FIG. 1 and FIG. 4. That is, the user may not wish to have forced reciprocating movement between the two pedals 50 and 52. Use of a cylinder 550 urges the pedal to move upward to a ready position so the user may move either pedal downward in a non-reciprocating fashion as desired by the user.

Figure 16:
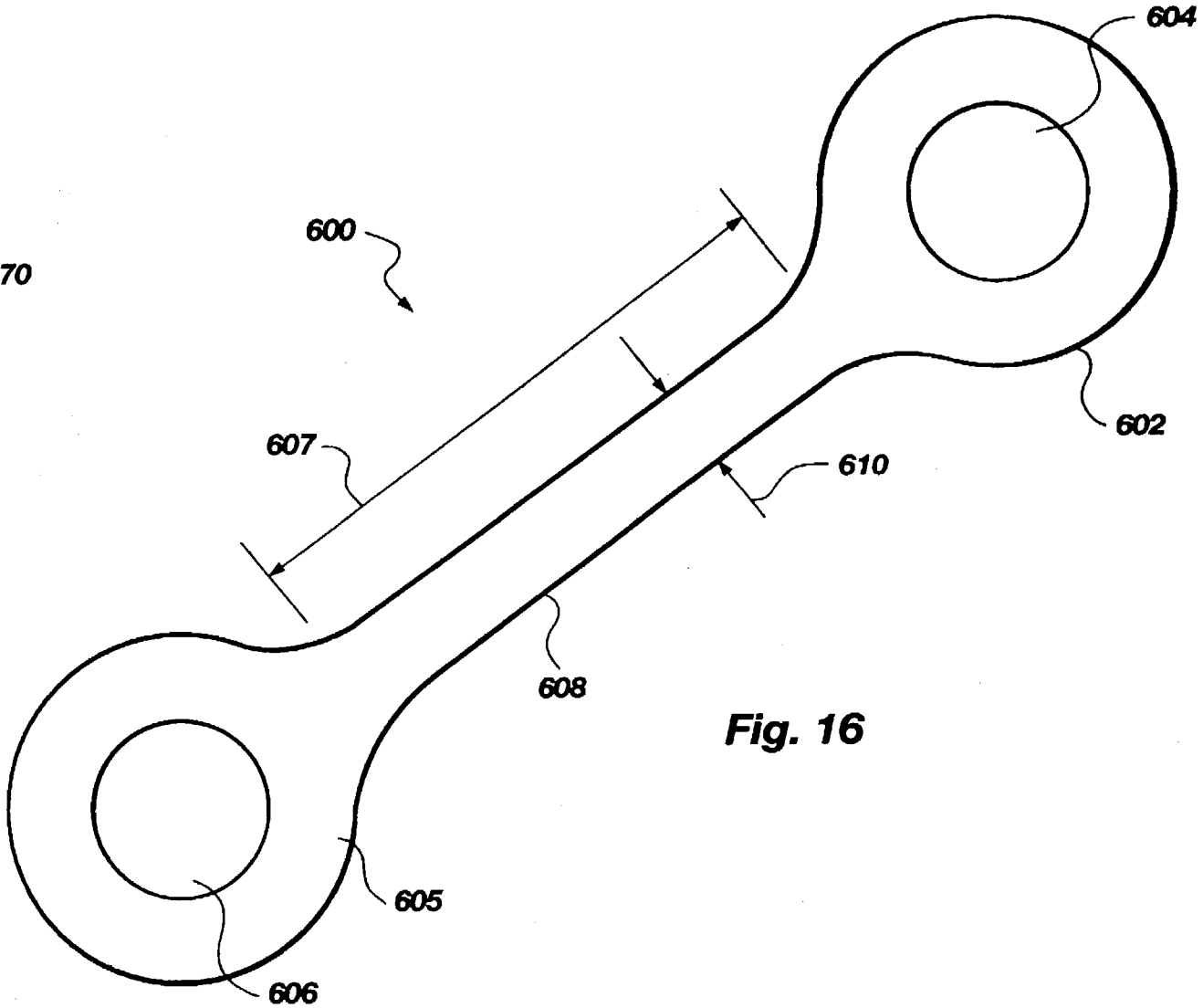
FIG. 16 is a side view of an alternate resistance means.

FIG. 16 depicts an alternate resistance member 600 for use with the exercise device of FIG. 1. That is, FIG. 16 depicts a rubber member having a first end 602 formed with an aperture 604 sized to fit snugly but slidably about pins or fingers such as those depicted in FIGS. 1 and 2 as hereinbefore described such as fingers 206A, 206B, 400, 404, 406, and 402. The other end 605 similarly has an aperture 606 formed therein similar in size to aperture 604. Between the ends 602 and 604 is a body 608 which is sized to extend therein-between a distance 607 to facilitate placement over appropriate pins such as those illustrated in FIG. 2 as pins 400 and 404.

The resistance member 600 of FIG. 16 is formed of an elastically deformable material such as rubber. The ends 602 and 605 are shaped with apertures 604 and 606 as shown so that accidental overstressing will not result in a portion of the resistance member being free to be projected to cause potential injury or damage. More specifically the aperture 604 and 606 are sized so the resistance member 600 is snugly but slidably positioned about respective pins such as pins 400, 404, 402 and 406. In the event the body 608 inelastically deforms and separates, the ends 602 and 605 will remain secured about their respective pins. Similarly, if an end such as end 602 or 605 is to separate or become damaged, the other end such as end 605 remains secure about its respective pin so that again the resistance member does not become a projectile and in turn a potential hazard to the user or surrounding objects.

Figure 9:
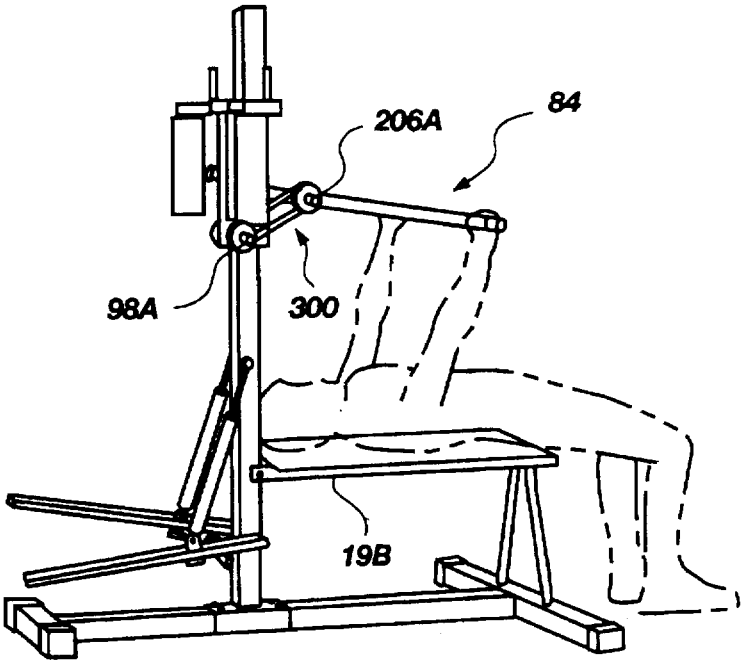
Figure 10:
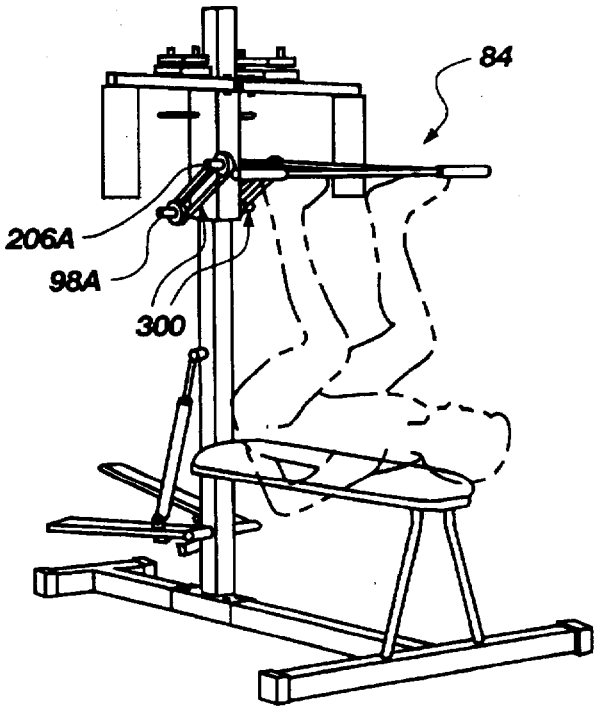

To provide resistance to exercise with the lateral bar assembly 84, a resistance element 300 (or 600) may be arranged to have the first pulley end 302 seated over finger 206A of the connector bar 206 which is fixed to the "Y"-shaped arm 202, and the other pulley end 304 seated over an side extension 98A of the carriage bar 98, as seen in FIGS. 9 and 10. A second resistance element 300 is similarly disposed on finger 206B and side extension 98B. This resistance configuration is useful to perform a variety of exercises including a bench press (FIG. 9), leg press (FIG. 10), military press, squat quad press, calf raises, and others.

Figure 11:
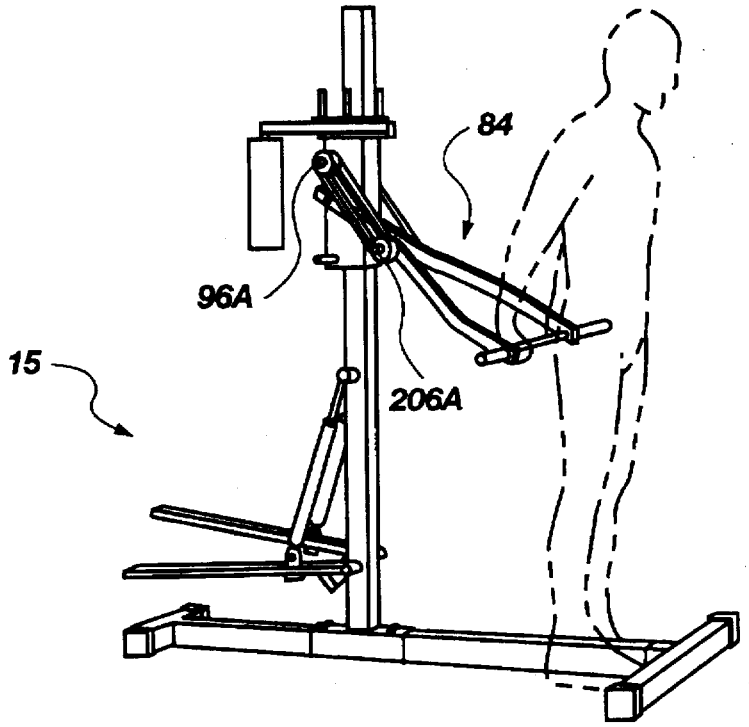
FIGS. 9, 10, 11 and 12 illustrate a user performing anaerobic exercises on the apparatus of the invention.

An alternative resistance configuration, shown in FIG. 11, has the first pulley ends 302 attached as previously described to the "Y"-shaped arms 200 and 202 via connector 206A and 206B, but with the other pulley ends 304 seated over one of the side extensions 96A and 96B of the carriage bar 96, instead of side extensions 98A and 98B. This resistance configuration is useful to perform exercises such as triceps push-downs (FIG. 11), lat pull-downs, and others. Notably, the configuration of FIG. 11 can be obtained without disassembly and relocation of the arms 200 and 202.

In the several configurations available, it can be seen that a plurality of resistance elements 300 can be used to increase the degree of difficulty or resistance to movement of the arms 200 and 202. Further, several loops may be formed to have different resistances to more easily develop the desired resistance.

Referring again to FIGS. 1 and 2, it is seen that a butterfly bar assembly 82 is mounted to carriage 80 above carriage bar 96 by means which includes a pair of mounting plates 350 and 352 best seen in FIG. 2. Mounting plates 350 and 352 are fixed to carriage assembly 80 by welding or the like. They are also secured to each other by pins 400 and 402 which are disposed toward the stepper portion 15 of the apparatus. Pivot pins 354 and 356 are disposed toward the weight bench portion 13 of the apparatus and also connect the mounting plates 350 and 352 while at the same time acting as the pivot or axles for butterfly arms 358 and 360. Pins 404 and 406 are secured to and extend upward from the arms 358 and 360. Butterfly grips 368 and 370 extend downward from the ends of arms 358 and 360, respectively. Optionally, grips 368, 370 are covered by pads 368A, 370A which may be of foam or other desired materials.

Figure 12:
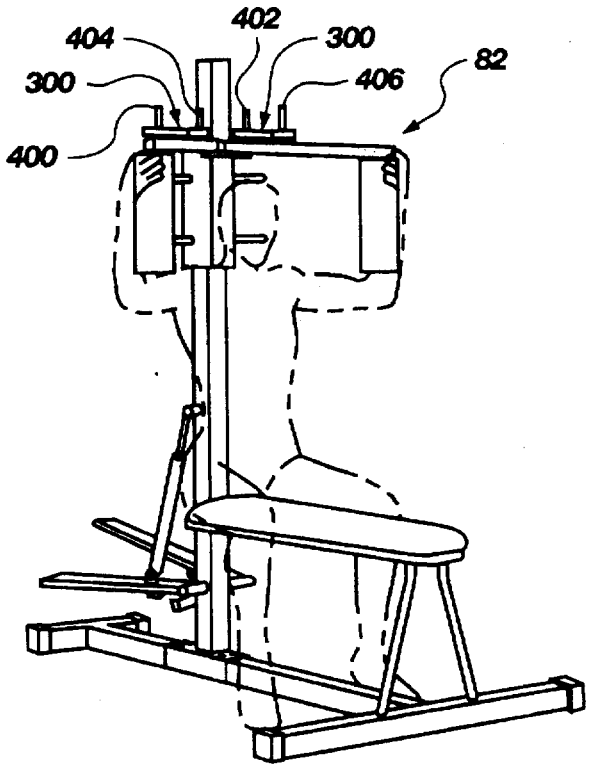

The resistance elements 300 of FIG. 3 may also be used as butterfly resistance means to provide resistance to exercises which are performed with the butterfly arms, such as that shown in FIG. 12. The first pulley end 302 of a resistance element is seated on mounting pin 400 which is fixed to the carriage assembly 80. The other pulley end 304 is seated on or over pin 404 which is fixed to butterfly arm 358. The two pulley ends of a second resistance means are seated respectively on pins 402 and 406.

Notably, the pulley loop 306 may be sized or formed to require more or less force to effect elastic deformation. The material may be of such composition or construction to provide a defined resistance. In operation, multiple resistance elements 300 may be positioned on the bars, pins and fingers as hereinbefore described to provide the user with a selectable resistance similar or comparable to selecting weights for a barbell. Resistance elements may be formed and assembled to provide resistance of, for example, 50, 100, 200 and 300 pounds for bench press exercises to accommodate the desires of different users.

It may be noted that the stepper portion 15 is here positioned spaced from and, as illustrated, opposite from the weight-training structure. The arrangement results in a more stable structure less disposed to movement in use.

The exercise machine of the instant application provides both an aerobic conditioning exercise and a wide variety of strength conditioning exercises in a single, relatively lightweight and durable apparatus. Because the apparatus is so lightweight, the ease of shipping is greatly enhanced and the cost of shipping is reduced. The apparatus is also less expensive to manufacture and more easily assembled.

Those skilled in the art will recognize the variations which do not vary from the teachings. The afore-described embodiments are not intended to limit the scope of the claims which themselves recite those features regarded as essential to the invention.

What is claimed is:

1. Apparatus for performing exercises, said apparatus comprising:

base support means for supporting said apparatus on a support surface;

a frame means having one or more frame members connected to and extending upward from said base support means;

stepping exercise means mechanically connected to said frame means for performance of stepping exercises by a user, said stepping exercise means including:

a first treadle spaced from a second treadles, said first treadle and said second treadle each being pivotally mounted to a frame member of said frame means, and resistance means interconnected between said frame member of said frame means and said first treadle and said second treadle to resist movement thereof; and anaerobic exercise means separate from said stepping exercise means and mechanically connected to said frame means for the performance of anaerobic exercises by a user, said anaerobic exercise means comprising:

carriage means movably adapted to said frame member of said frame means to move therealong, and connecting means for connecting said carriage means to said frame member in any of a plurality of selected positions spaced along said frame member, strengthening exercise means adapted to said frame means for the performance of strengthening exercises by said user, said strengthening exercise means including:

a lever member pivotally connected to said frame means with resistance means interconnected between said lever member and said frame means to resist movement of said lever member from a first position to a second position, and movable structure attached to said carriage means.

2. The apparatus of claim 1 further including bench means for receiving a user thereon, said bench means having a first end removably attachable to said frame members of said frame means and a second end having support members adapted to said frame member of said frame means to support said second end above said base support means.

3. The apparatus of claim 1 wherein said carriage means is formed to have a channel sized to snugly and slidably receive said frame member of said frame means therethrough, said frame member of said frame means having a length and said carriage means being movable along said length.

4. The apparatus of claim 3 wherein the channel of said carriage means is defined by opposite and spaced-apart cheek members extending proximate said a frame member of said frame means and away therefrom.

5. The apparatus of claim 1 wherein said resistance means has a first end removably secured to said carriage means and a second end removably secured to said lever member, and wherein said carriage means has first securing means positioned relative to said lever member for securing said resistance means to said carriage means in a first configuration and a second securing means positioned relative to said lever member and spaced from said first securing means for securing said resistance means to said carriage means in a second configuration.

6. The apparatus of claim 5 wherein said lever member has a pair of spaced-apart arms sized to snugly and slidably receive said carriage means therebetween.

7. The apparatus of claim 6 wherein said carriage has check members which are opposite each other and spaced apart, wherein said first securing means and said second securing means are first and second pins respectively which extend outwardly from each of the cheek members, wherein said arms each have a finger extending outwardly therefrom, and wherein said resistance means includes at least one resistance module connected between a finger and a first or second pin selected by the user.

8. The apparatus of claim 7 wherein said resistance module is an elastically deformable member having an aperture formed in each end positionable about said finger and a first pin or second pin as selected by a user.

9. The apparatus of claim 7 wherein said resistance module is an elastic member formed in an unending resilient loop and trainable about said finger and a first pin or second pin selected by the user.

10. The apparatus of claim 9 wherein said resistance module includes a pair of spool-shaped ends each including a cylinder with two ends, with an aperture formed through said cylinder sized to snugly and slidably receive said finger and said first and second pins, and wherein said elastic member is trained about a portion of said cylinder of both of said spool-shaped ends.

11. The apparatus of claim 10 wherein said spool-shaped ends each further include a loop shield means attached thereto for shielding said user from said resilient loop.

12. The apparatus of claim 1 further including a left arm and a right arm pivotally attached to said carriage means for rotation toward each other to perform butterfly-type exercises.

13. The apparatus of claim 1 wherein said resistance means includes a resilient loop and a pair of spool-shaped ends each including a cylinder with two ends, with an aperture formed through said cylinder sized to selectively, snugly and slidably receive said first and second fingers and said first an second pins, and wherein said resilient loop is trained about a portion of said cylinder of each of said spool-shaped ends.

14. The apparatus of claim 1 further including: reciprocator means to cause said first treadle and said second treadle to reciprocate with respect to each other, said reciprocator means including rocker means attached to said frame member of said frame means to contact both said first treadle and said second treadle, said rocker means having a midpoint about which its opposite ends rotate, one of said opposite ends being positioned under each of said first and second treadles.

15. The apparatus of claim 14 wherein said rocker means further includes a first roller and a second roller, each being mounted at one of said rocker ends, said rollers each having engaging means to connect to one of said first treadle and said second treadle.

16. The apparatus of claim 1 wherein said resistance means includes means to urge said first treadle and said second treadle to a position ready for stepping operation by a user.

17. The apparatus of claim 1 wherein said stepping exercise means is connected to said first frame member of said frame means.

18. The apparatus of claim 1 wherein said stepping exercise means is connected to a second frame member of said frame means.

19. The apparatus of claim 17 wherein said stepping exercise means includes a first treadle spaced from a second treadle, said first treadle and said second treadle each being pivotally mounted to said first frame member, and resistance means interconnected between said first frame member and said first treadle and said second treadle to resist movement thereof, and reciprocator means to cause said first treadle and said second treadle to reciprocate with respect to each other, said reciprocator means including rocker means attached to said first frame member, said rocker means having opposite ends which respectively contact said first and second treadles and a midpoint about which said opposite ends rotate.

20. The apparatus of claim 19 wherein said rocker means further includes a first roller and a second roller which are respectively mounted to said opposite rocker ends in respective engaging contact with said first and second treadles.

21. The apparatus of claim 18 wherein said stepping exercise means includes a first treadle spaced from a second treadle, said first treadle and said second treadle each being pivotally mounted to said second frame member, and resistance means interconnected between said second frame member and said first treadle and said second treadle to resist movement thereof, and reciprocator means to cause said first treadle and said second treadle to reciprocate with respect to each other, said reciprocator means including rocker means attached to said second frame member, said rocker means having opposite ends which respectively contact said first and second treadles and a midpoint about which said opposite ends rotate.

22. The apparatus of claim 21 wherein said rocker means further includes a first roller and a second roller which are respectively mounted to said opposite rocker ends in respective engaging contact with said first and second treadles.

23. The apparatus of claim 14 wherein said stepping exercise means is connected to said frame member of said frame member.

* * * * *